US012595432B2

(12) United States Patent
Dunham

(10) Patent No.: US 12,595,432 B2
(45) Date of Patent: Apr. 7, 2026

(54) ADDITIVES FOR INCREASED FUEL EFFICIENCY FOR LIQUID FUELS USED IN COMBUSTION ENGINES AND METHODS FOR USING THE SAME

(71) Applicant: Joseph Dunham, Columbia, SC (US)

(72) Inventor: Joseph Dunham, Columbia, SC (US)

( * ) Notice: Subject to any disclaimer, the term of this patent is extended or adjusted under 35 U.S.C. 154(b) by 0 days.

(21) Appl. No.: 19/174,439

(22) Filed: Apr. 9, 2025

(65) Prior Publication Data

US 2026/0062632 A1 Mar. 5, 2026

Related U.S. Application Data

(60) Provisional application No. 63/691,192, filed on Sep. 5, 2024.

(51) Int. Cl.
*C10L 1/198* (2006.01)

(52) U.S. Cl.
CPC ..... *C10L 1/1985* (2013.01); *C10L 2200/0423* (2013.01); *C10L 2230/22* (2013.01); *C10L 2250/04* (2013.01); *C10L 2270/023* (2013.01)

(58) Field of Classification Search
CPC ..... C10L 1/1985; C10L 2200/0423; C10L 2230/22; C10L 2250/04; C10L 2270/023
See application file for complete search history.

(56) References Cited

U.S. PATENT DOCUMENTS

| | | | | |
|---|---|---|---|---|
| 3,447,914 | A * | 6/1969 | Peterson | C08K 5/01 44/271 |
| 5,858,031 | A * | 1/1999 | Perlman | C10L 1/003 44/452 |
| 6,835,218 | B1 | 12/2004 | Drozd et al. | |
| 2006/0057530 | A1 | 3/2006 | Kubicek et al. | |
| 2017/0226329 | A1 | 8/2017 | Malotky et al. | |

OTHER PUBLICATIONS

International Search Report and Written Opinion for Patent Cooperation Treaty Application No. PCT/US2025/023896, dated Jul. 30, 2025, 13 pages.

* cited by examiner

*Primary Examiner* — Cephia D Toomer
(74) *Attorney, Agent, or Firm* — ALSTON & BIRD LLP

(57) ABSTRACT

Disclosed are fuel additives and methods for making and using the same. A fuel additive can ethyl cellulose. A mass of ethyl cellulose in powder form can be mixed with or into a volume of a petrochemical, such as gasoline, in liquid form. The ethyl cellulose powder may at least partially dissolve in the liquid petrochemical. Heat may be applied to improve dissolution of the ethyl cellulose in the liquid petrochemical. The ethyl cellulose/gasoline fuel mixture produced therefrom can be combusted in a combustion engine, such as a small combustion engine. Combustion testing shows that the ethyl cellulose/gasoline fuel mixture exhibits greater than about 150% increase in fuel efficiency relative to gasoline alone. Other additives and stabilizers can be added to stabilize the mixture.

19 Claims, 6 Drawing Sheets

ADDITIVES FOR INCREASED FUEL EFFICIENCY FOR LIQUID FUELS USED IN COMBUSTION ENGINES AND METHODS FOR USING THE SAME

CROSS-REFERENCE TO RELATED APPLICATIONS

This application claims the benefit of priority to U.S. Provisional Application Ser. No. 63/691,192, which was filed on Sep. 5, 2024, the entire disclosure of which is hereby incorporated herein by reference in its entirety for all purposes.

TECHNICAL FIELD

The present invention relates, generally, to liquid fuels for use in combustion engines and, more specifically, to additives for increasing fuel efficiency for liquid fuels used in combustion engines.

BACKGROUND

Combustion engines typically consume liquid fuel to generate power, such as mechanical power or electrical power, to operate equipment, vehicles, etc. Some combustion engines, such as internal combustion engines (ICEs), operate by igniting a mixture of air and liquid fuel within a confined space, typically a cylinder. This ignition process, often initiated by a spark plug in gasoline engines or by compression in diesel engines, results in a rapid expansion of gases. The expanding gases exert pressure on the piston, converting chemical energy from the fuel into mechanical energy. This mechanical energy is then transmitted through the crankshaft to perform work. Efficient liquid fuel consumption in ICEs is critical, as it directly impacts the engine's performance, fuel economy, and emissions. Advanced fuel injection systems and precise control of the air-fuel ratio are essential for optimizing combustion and minimizing fuel wastage.

However, combustion of liquid fuels leads to the generation and point-source emission of greenhouse gases, such as carbon dioxide and methane. Additionally, the cost of liquid fuels has generally increased over time. Certain fuel additives, such as ethanol, have been considered and present often serious drawbacks. For example, ethanol is very difficult to store and transport because it is extremely corrosive. Additionally, from a life cycle environmental impacts perspective, the product of ethanol, depending on the source and conversion process used, can require more fossil fuel inputs during production and transportation than the amount of fossil fuel use that the produced ethanol offsets. As such, there is a continued need for fuel additives that improve fuel efficiency, reduce the direct and indirect impacts of fuel use and combustion in vehicles and/or equipment, and which do not negatively impact the operation or maintenance of the vehicles and/or equipment in which the fuel is being combusted.

As such, there is a continued need to improve fuel efficiency, such as to reduce cost, to reduce greenhouse gas emissions, and for other reasons.

SUMMARY

Various example embodiments described herein relates to additives for use in liquid fuels, liquid fuels comprising additives, and methods for making and using liquid fuel-additive mixtures.

According to one aspect, a composition of matter is provided that includes a volume of a liquid fuel and a mass of an ethyl cellulose powder disposed within the volume of the liquid fuel to form an ethyl cellulose/liquid fuel mixture. In some embodiments, a concentration of the ethyl cellulose powder in the liquid fuel is between about 0.01 g/mL and about 0.1 g/mL. In some embodiments, the ethyl cellulose/liquid fuel mixture has a first fuel efficiency during combustion of the ethyl cellulose/liquid fuel mixture in a combustion engine of between about 150% and about 175% greater than a second fuel efficiency of the liquid fuel itself during combustion of a same volume of the liquid fuel in the combustion engine. In some embodiments, the mass of ethyl cellulose powder disposed within the volume of the liquid fuel is at least partially dissolved within the volume of the liquid fuel. In some embodiments, the liquid fuel comprises a petrochemical in liquid form. In some embodiments, the petrochemical in liquid form is gasoline.

According to another aspect, a method can be provided or performed that includes providing a mass of a fuel additive comprising a cellulosic material, the fuel additive being in powder form and mixing the mass of the fuel additive into a volume of a liquid petrochemical fuel to form an additive-fuel mixture. In some embodiments, the method can further comprise heating the additive-fuel mixture until all or substantially all of the mass of the fuel additive in powder form is dissolved into the volume of the liquid petrochemical fuel. In some embodiments, the mixing the mass of the fuel additive into the volume of the liquid petrochemical fuel is carried out using one of: a paddle mixer, a static mixer, or using intra-tank turbulence. In some embodiments, the fuel additive comprises a cellulose-comprising material. In some embodiments, the cellulose-comprising material is ethyl cellulose. In some embodiments, the mass of ethyl cellulose in the ethyl cellulose/liquid fuel mixture is between about 0.01 g/mL of the liquid fuel and about 0.1 g/mL of the liquid fuel.

According to another embodiment, a fuel additive/liquid fuel mixture can be provided that comprises a volume of gasoline and a mass of ethyl cellulose disposed within the volume of gasoline. In some embodiments, a concentration of the ethyl cellulose in the gasoline is between about 0.01 g/mL and about 0.1 g/mL. In some embodiments, the mass of ethyl cellulose before being disposed within the volume of gasoline in a powder form. In some embodiments, at least a portion of the mass of ethyl cellulose once disposed within the volume of gasoline is dissolved into the volume of the gasoline to form the fuel additive/liquid fuel mixture. In some embodiments, a rate of dissolution of the ethyl cellulose within the gasoline increases with a temperature of the fuel additive/liquid fuel mixture. In some embodiments, the fuel additive/liquid fuel mixture has a first fuel efficiency during combustion of the fuel additive/liquid fuel mixture in a combustion engine of between about 150% and about 175% greater than a second fuel efficiency of gasoline itself during combustion of an equivalent volume of gasoline in the combustion engine.

The above summary is provided merely for purposes of providing an overview of one or more exemplary embodiments described herein so as to provide a basic understanding of some aspects of the disclosure. Accordingly, it will be appreciated that the above-described embodiments are merely examples and should not be construed to narrow the scope or spirit of the disclosure in any way. It will be appreciated that the scope of the disclosure encompasses many potential embodiments in addition to those here summarized, some of which are further explained within the following detailed description and its accompanying drawings.

BRIEF DESCRIPTION OF THE DRAWINGS

The description of the illustrative embodiments can be read in conjunction with the accompanying figures. It will be appreciated that for simplicity and clarity of illustration, elements illustrated in the figures have not necessarily been drawn to scale. For example, the dimensions of some of the elements are exaggerated relative to other elements. Embodiments incorporating teachings of the present disclosure are shown and described with respect to the figures presented herein, in which.

DETAILED DESCRIPTION

Figure 1:
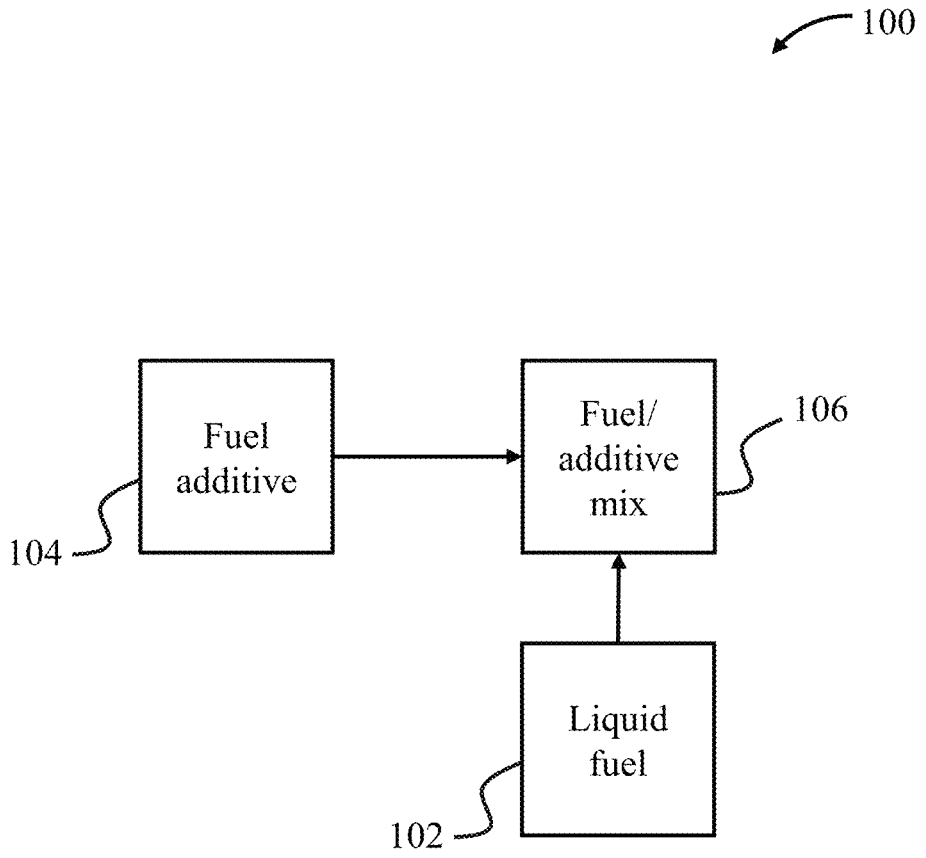
FIG. 1 is a schematic illustration of a process for formulating a liquid fuel/fuel additive mixture, in accordance with one or more embodiments of the present disclosure.

Some embodiments of the present disclosure will now be described more fully hereinafter with reference to the accompanying drawings, in which some, but not all embodiments of the disclosure are shown. Indeed, these disclosures may be embodied in many different forms and should not be construed as limited to the embodiments set forth herein; rather, these embodiments are provided so that this disclosure will satisfy applicable legal requirements. Like numbers refer to like elements throughout. Terminology used in this patent is not meant to be limiting insofar as devices described herein, or portions thereof, may be attached or utilized in other orientations.

The phrases "in one embodiment," "according to one embodiment," "in some embodiments," and the like generally mean that the particular feature, structure, or characteristic following the phrase may be included in at least one embodiment of the present disclosure, and may be included in more than one embodiment of the present disclosure (importantly, such phrases do not necessarily refer to the same embodiment).

The word "exemplary" is used herein to mean "serving as an example, instance, or illustration." Any implementation described herein as "exemplary" is not necessarily to be construed as preferred or advantageous over other implementations.

If the specification states a component or feature "may," "can," "could," "should," "would," "preferably," "possibly," "typically," "optionally," "for example," "often," or "might" (or other such language) be included or have a characteristic, that particular component or feature is not required to be included or to have the characteristic. Such component or feature may be optionally included in some embodiments, or it may be excluded.

In the specification, terms such as "about," "substantially," "approximately," "nearly," "almost," and/or the like refer to any and all values within a range of plus 10% and minus 10% (i.e., +10%) relative to the stated value. For example, "about 10 wt. %" would include all values and value ranges between 9.0 wt. % and 11 wt. %, "about 250 μm" would include all values and value ranges between 225 μm and 275 μm, and "about 1 hour" would all values and value ranges between 54 minutes and 66 minutes. Any provided value, whether or not it is modified by terms such as "about," "substantially," "approximately," "nearly," "almost," and/or the like, all refer to and hereby disclose associated values or ranges of values thereabout, as described above.

As used herein, the terms "fuel," "transportation fuel," "liquid fuel," "petrochemical," "gasoline," "gas," and similar terms may be used interchangeably to refer to a liquid fuel into which an additive can be incorporated, in accordance with certain embodiments of the present invention. Thus, use of any such terms should not be taken to limit the spirit and scope of embodiments of the present invention.

Fuel additives can be or comprise a variety of different materials, either in addition to or instead of ethyl cellulose. For example, other materials have been contemplated as fuel additives, such as ethanol, ethyl tertiary butyl ether (ETBE), and methyl tertiary butyl ether (MTBE), which are oxygenates that enhance combustion efficiency by increasing the oxygen content in fuels. Other additives can include, e.g., isopropyl ether, aniline, diethylamine, dimethyl malonate, and p-tert-butylphenol. These additives can improve fuel properties, reduce engine deposits, and enhance overall performance.

However, impact of these and other fuel additives on fuel efficiency varies. Ethanol and ETBE generally improve fuel efficiency by promoting cleaner combustion and reducing engine deposits. However, the effectiveness of other additives like diethylamine and dimethyl malonate can differ based on the specific fuel formulation and engine type. Some additives were determined to offer only slight improvements in fuel consumption, while others had no or negligible effect on fuel consumption.

Additionally, combusting fuels with some of these additives can lead to various emission concerns. Oxygenates like ethanol and ETBE can reduce carbon monoxide (CO) and hydrocarbon (HC) emissions. However, certain additives may increase nitrogen oxides (NOx) and particulate matter (PM) emissions. For instance, diethylamine can reduce CO emissions but may increase NOx emissions. Additionally, high treat rates of deposit control additives can lead to increased PM emissions and stochastic pre-ignition events in gasoline direct injection engines.

Furthermore, other fuel additives were contemplated, including magnesium with toluene, water with ethyl, etc. However, the combustion of fuels comprising these materials either led to increased engine wear or increased point-source emissions of certain gases that may be toxic.

Described herein are additives for use in liquid fuels to improve a fuel efficiency of the liquid fuel and/or reduce greenhouse gas emissions. The additive can be in a liquid form, a solid form, or a gaseous form. For example, in some embodiments, the additive can be provided in a solid (e.g., powder) form.

Illustrated in FIG. 1 is a process 100 for making a fuel additive, in accordance with some embodiments of the present disclosure. As shown, the process 100 includes providing a liquid fuel 102. The provided liquid fuel 102 can be or comprise any suitable liquid fuel or combination of liquid fuels. For example, the provided liquid fuel 102 can be or comprise gasoline, diesel, kerosene, ethanol, methanol, biodiesel, biogasoline, biofuel, crude oil, fuel oil, jet fuel, and/or the like. The provided liquid fuel 102 can be provided in a container or tank that is in operable communication with a combustion engine configured to combust the provided liquid fuel 102 to enable operation of, e.g., equipment, a vehicle, or the like. In other embodiments, the provided liquid fuel 102 can be provided in a separate container that is not in operable communication with the combustion engine. For example, the provided liquid fuel 102 can be provided in a mixing container.

The process 100 further comprises providing a fuel additive 104. The provided fuel additive 104 can be or comprise an ethyl-containing material. For example, the provided fuel additive 104 can be or comprise ethyl cellulose, which has the following chemical formulation:

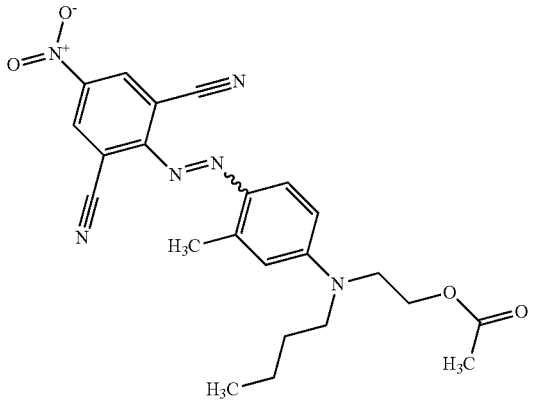

In some embodiments, the provided fuel additive 104 can comprise ethyl cellulose generated using a chemical process, such as etherification, from a feedstock of cellulose derived from one or more cellulosic and/or lignocellulosic sources, such as wood pulp or cotton linters. The etherification of cellulose to form ethyl cellulose can involve a process in which the cellulose undergoes purification to remove impurities such as lignin and hemicellulose, the purified cellulose is then reacted with ethyl chloride in the presence of a catalyst, such as an acid like sulfuric acid or an acidic salt like zinc chloride, which causes an exothermic reaction and facilitates the substitution of hydroxyl groups in the cellulose molecules with ethyl groups to form ethyl cellulose. The ethyl cellulose can then be neutralized, washed to remove residual catalysts and by-products, dried, and ground to achieve an ethyl cellulose powder having a desired particle size (e.g., particle size distribution) and consistency.

As such, the provided fuel additive 104 can comprise ethyl cellulose for which some of the hydroxyl groups on the repeating glucose units of the cellulose are replaced with ethyl ether groups. This modification (the exchange of hydroxyl groups for ethyl ether groups) may impart several unique properties to the provided fuel additive 104. For example, ethyl cellulose has a melting point of about 240° C. to about 255° C. and a density of about 1.14 g/mL at 25° C. Ethyl cellulose is also insoluble in water but soluble in organic solvents such as esters, aromatic hydrocarbons, alcohols, and ketones. Ethyl cellulose also exhibits low moisture absorption, excellent dimensional stability, and resistance to acids and alkalis. These characteristics make ethyl cellulose suitable for applications requiring water repellency, film-forming properties, and chemical stability, such as for use as or comprised in the provided fuel additive 104.

The process 100 further comprises forming a fuel/additive mix 106 from the provided liquid fuel 102 and the provided fuel additive 104. In some embodiments, the formed fuel/additive mix 106 can be formed directly within a container or tank in operable communication with a combustion engine. In other embodiments, the formed fuel/additive mix 106 can be formed within an external container that is not in operable communication with a combustion engine.

In some embodiments, the provided fuel additive 104, which is or comprises ethyl cellulose (e.g., in powder form), can be mixed with the provided liquid fuel 102, which is or comprises gasoline, to form a fuel/additive mixture 106 with enhanced combustion performance and stability, and which achieves increased fuel efficiency. In other embodiments, the provided liquid fuel 102 can be combined with the provided fuel additive 104 to form the fuel/additive mixture 106.

In some embodiments, the mixing of the provided fuel additive 104 and the provided liquid fuel 102 to form the fuel/additive mixture 106 can be carried out using any suitable mixing means. For example, mixing can be performed by movement of the container into which the provided fuel additive 104 and provided liquid fuel 102 are disposed or combined. In some embodiments, the mixing can be performed using a mixer, a mixing wand, a shaker, a static mixer, a paddle, etc. In some embodiments, mixing is performed or facilitated via fluid dynamic forces exerted by the materials themselves and/or the container, when disposing the provided liquid fuel 102 into the container and onto the provided fuel additive 104.

In some embodiments, heat may be applied during the forming the fuel/additive mixture 106. Without wishing to be bound by any particular theory, the heat applied during the forming the fuel/additive mixture 106 can lead to better/increased dissolution, mixing, dispersion, dissipation, or homogeneity of the provided fuel additive 104 in the formed fuel/additive mixture 106.

As a cellulose-derived oxygenate, ethyl cellulose can improve the combustion efficiency of fuels by increasing their oxygen content, which may help achieve more complete combustion, which may reduce emissions of pollutants such as greenhouse gases. Additionally, ethyl cellulose's solubility in organic solvents can improve the compatibility of the fuel additive across various fuel formulations. In some embodiments, ethyl cellulose may exhibit film-forming properties which may contribute to the stabilization of fuel mixtures, preventing phase separation and ensuring uniform distribution of additives. These attributes make ethyl cellulose a valuable component in the development of cleaner and more efficient fuel blends.

In some embodiments, the provided fuel additive 104 can be fully or partially bio-based. The provided fuel additive 104 can comprise a cellulosic, cellulose-comprising, or cellulose-based fuel additive. The provided fuel additive 104 can be in powder form. The provided fuel additive 104 can include or be ethyl cellulose.

A method can be carried out for preparing the provided fuel additive 104 that includes preparing alkali cellulose by mixing cellulose fibers with water and caustic, heating the alkali cellulose in the presence of ethyl chloride, alkyl halide, or another suitable material, and extracting the ethyl cellulose produced. The extracted ethyl cellulose can be dried to form a powder thereof.

Another method can be carried out for using the provided fuel additive 104 that includes mixing a mass of ethyl cellulose in powder form with a volume of the provided liquid fuel 102 (e.g., a petrochemical, such as gasoline). The ethyl cellulose powder in the provided fuel additive 104 can dissolve or partially dissolve in the liquid petrochemical of the provided liquid fuel 102. Heat may be applied to improve dissolution of the ethyl cellulose in the liquid petrochemical.

In some embodiments, a particular ratio or range of ratios of mixing of the provided fuel additive 104 to the provided liquid fuel 102 can be used. To simplify the discussion of various ratios of the provided fuel additive 104 to the provided liquid fuel 102, the ratio is presented as a concentration of the provided fuel additive 104 in the provided liquid fuel 102. While a range of various concentrations of the provided fuel additive 104 in the provided fuel additive 104 are contemplated and contained within the present disclosure, several specific concentration values and ranges are discussed below as non-limiting examples.

In some embodiments, the provided fuel additive 104 can have a purity of between about 20% and 100%, but most formulations were found to be between about 40% pure and about 60% pure.

A range of concentrations of the provided fuel additive 104 to the provided liquid fuel 102 can be used when forming the fuel/additive mixture 106. For example, the concentration of the provided fuel additive 104 to the provided liquid fuel 102 in the formed fuel/additive mixture 106 can be in the range of about 0.005 g/mL to about 0.5 g/mL, inclusive of all values and ranges therebetween. In one embodiment, the formed fuel/additive mixture 106 can comprise about 0.01 g/mL of ethyl cellulose in gasoline (e.g., gasoline having an octane rating of between about 85 and about 93). In some embodiments, the formed fuel/additive mixture 106 can comprise about 0.02 g/mL of ethyl cellulose in gasoline (e.g., gasoline having an octane rating of between about 85 and about 93). In some embodiments, the formed fuel/additive mixture 106 can comprise about 0.05 g/mL of ethyl cellulose in gasoline (e.g., gasoline having an octane rating of between about 85 and about 93). In some embodiments, the formed fuel/additive mixture 106 can comprise about 0.07 g/mL of ethyl cellulose in gasoline (e.g., gasoline having an octane rating of between about 85 and about 93). In some embodiments, the formed fuel/additive mixture 106 can comprise about 0.10 g/mL of ethyl cellulose in gasoline (e.g., gasoline having an octane rating of between about 85 and about 93).

As a non-limiting example, a formed fuel/additive mixture 106 was prepared for a small engine application (e.g., an edge trimmer, lawn mower, blower, etc.) by mixing about 2 tsp of ethyl cellulose in powder form into about 8 fl. oz. of gasoline. Applying a unit conversion of about 1 tsp to about 4.93 mL, the approximately 2 tsp of ethyl cellulose added to the gasoline is equivalent to about 9.86 mL. Assuming a density of ethyl cellulose of about 1.14 g/mL, this equates to about 11.24 g of ethyl cellulose added to the gasoline. Based on a unit conversion of about 29.5735 mL to 1 fl. oz., the volume of gasoline was about 236.59 mL. This resulted in a mixture of about 11.24 g of ethyl cellulose to about 236.59 mL of gasoline, for a concentration of the provided fuel additive 104 in the formed fuel/additive mixture 106 of about 0.045 g/mL.

As another non-limiting example, a formed fuel/additive mixture 106 was prepared for a small engine application (e.g., an edge trimmer, lawn mower, blower, etc.) by mixing about 1 tsp of ethyl cellulose in powder form into about 8 fl. oz. of gasoline. Applying a unit conversion of about 1 tsp to about 4.93 mL, approximately 4.93 mL of ethyl cellulose was added to the gasoline. Assuming a density of ethyl cellulose of about 1.14 g/mL, this equates to about 5.62 g of ethyl cellulose added to the gasoline. Based on a unit conversion of about 29.5735 mL to 1 fl. oz., the volume of gasoline was about 236.59 mL. This resulted in a mixture of about 5.62 g of ethyl cellulose to about 236.59 mL of gasoline, for a concentration of the provided fuel additive 104 in the formed fuel/additive mixture 106 of about 0.023 g/mL.

As another non-limiting example, a formed fuel/additive mixture 106 was prepared for a small engine application (e.g., an edge trimmer, lawn mower, blower, etc.) by mixing about 3 tsp of ethyl cellulose in powder form into about 8 fl. oz. of gasoline. Applying a unit conversion of about 1 tsp to about 4.93 mL, approximately 14.79 mL of ethyl cellulose was added to the gasoline. Assuming a density of ethyl cellulose of about 1.14 g/mL, this equates to about 16.86 g of ethyl cellulose added to the gasoline. Based on a unit conversion of about 29.5735 mL to 1 fl. oz., the volume of gasoline was about 236.59 mL. This resulted in a mixture of about 16.86 g of ethyl cellulose to about 236.59 mL of gasoline, for a concentration of the provided fuel additive 104 in the formed fuel/additive mixture 106 of about 0.067 g/mL.

Figure 2:
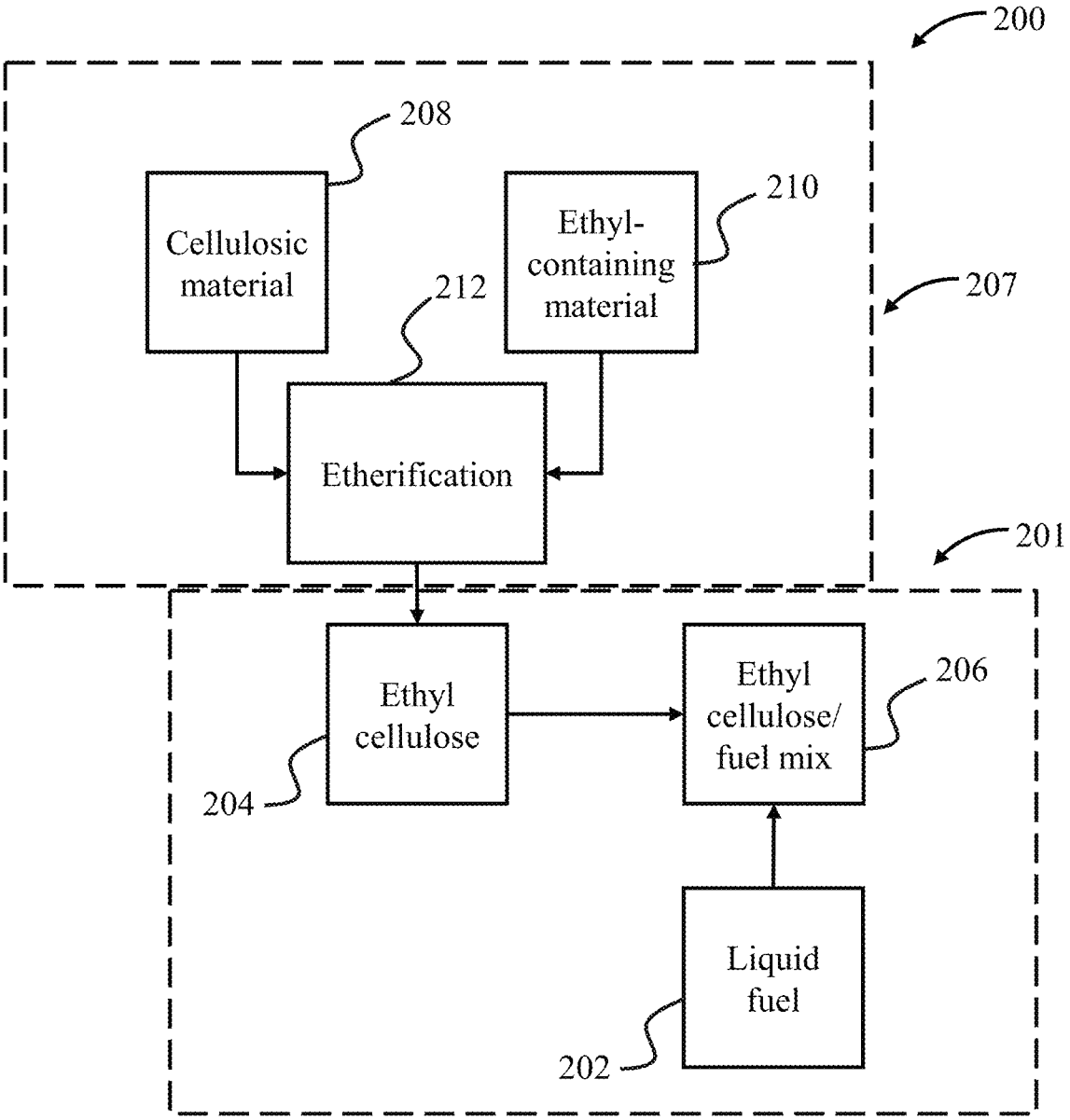
FIG. 2 is a schematic illustration of a process for formulating a liquid fuel/fuel additive mixture, in accordance with one or more embodiments of the present disclosure.

Referring now to FIG. 2, a process 200 is illustrated for making a fuel additive, in accordance with some embodiments of the present disclosure. As shown, the process 200 includes an additive preparation 207. As part of additive preparation 207, the process 200 can comprise providing a cellulosic material 208. The provided cellulosic material 208 can be or comprise any suitable cellulose-comprising material, cellulose-containing material, or cellulose-based material. For example, the provided cellulosic material 208 can be sourced from one or a variety of lignocellulosic materials, such as trees, grasses, flax, hemp, jute, etc. In other embodiments, the provided cellulosic material 208 can be sourced from one or a variety of cellulosic materials, such as fluff pulp, recycled cellulose, lab grade cellulose, cotton, and/or the like. In some embodiments, cellulose can be derived from the provided cellulosic material 208.

Further, as part of the additive preparation 207, the process 200 can further comprise providing an ethyl-containing material 210, such as ethyl ether, ethyl chloride, or the like. Further, during additive preparation 207, the process 200 can further comprise performing etherification 212 of the cellulose derived from the cellulosic material 208. The etherification 212 of the cellulose derived from the provided cellulosic material 208 using the provided ethyl-containing material 210 can produce ethyl cellulose.

The process 200 can further comprise fuel/additive mixing 201. In fuel/additive mixing 201, the process 200 can further comprise providing ethyl cellulose 204, which can be the same or similar ethyl cellulose as produced via the etherification 212. During the fuel/additive mixing 201, the process 200 can further comprise providing a liquid fuel 202. The provided liquid fuel 202 can be or comprise any suitable liquid fuel or combination of liquid fuels. For example, the provided liquid fuel 202 can be or comprise gasoline, diesel, kerosene, ethanol, methanol, biodiesel, biogasoline, biofuel, crude oil, fuel oil, jet fuel, and/or the like. The provided liquid fuel 202 can be provided in a container or tank that is in operable communication with a combustion engine configured to combust the provided liquid fuel 202 to enable operation of, e.g., equipment, a vehicle, or the like. In other embodiments, the provided liquid fuel 202 can be provided in a separate container that is not in operable communication with the combustion engine. For example, the provided liquid fuel 202 can be provided in a mixing container.

In some embodiments, the provided ethyl cellulose 204 can be or comprise ethyl cellulose generated using a chemical process, such as etherification 212, from a feedstock of cellulose derived from the cellulosic material 208, which can be from one or more cellulosic and/or lignocellulosic sources, such as wood pulp or cotton linters. The etherification 212 of cellulose to form ethyl cellulose can involve a sub-process in which the cellulose derived from the provided cellulosic material 208 undergoes purification to remove impurities such as lignin and hemicellulose, the purified cellulose is then reacted with an ethyl-containing material, such as ethyl chloride, ethyl ether, or the like, e.g., in the presence of a catalyst, such as an acid like sulfuric acid or an acidic salt like zinc chloride, which causes an exothermic reaction and facilitates the substitution of hydroxyl groups in the cellulose molecules with ethyl groups to form ethyl cellulose. The resulting ethyl cellulose can then be neutralized, washed to remove residual catalysts and by-products, dried, and ground to achieve an ethyl cellulose powder having a desired particle size (e.g., particle size distribution) and consistency. This neutralized, washed, dried, and ground ethyl cellulose powder can be or comprise the provided ethyl cellulose.

Referring now to FIG. 2, a process 200 is illustrated for making a fuel additive, in accordance with some embodiments of the present disclosure. As shown, the process 200 includes an additive preparation 207. As part of additive preparation 207, the process 200 can comprise providing a cellulosic material 208. The provided cellulosic material 208 can be or comprise any suitable cellulose-comprising material, cellulose-containing material, or cellulose-based material. For example, the provided cellulosic material 208 can be sourced from one or a variety of lignocellulosic materials, such as trees, grasses, flax, hemp, jute, etc. In other embodiments, the provided cellulosic material 208 can be sourced from one or a variety of cellulosic materials, such as fluff pulp, recycled cellulose, lab grade cellulose, cotton, and/or the like. In some embodiments, cellulose can be derived from the provided cellulosic material 208.

Further, as part of the additive preparation 207, the process 200 can further comprise providing an ethyl-containing material 210, such as ethyl ether, ethyl chloride, or the like. Further, during additive preparation 207, the process 200 can further comprise performing etherification 212 of the cellulose derived from the cellulosic material 208. The etherification 212 of the cellulose derived from the provided cellulosic material 208 using the provided ethyl-containing material 210 can produce ethyl cellulose.

The process 200 can further comprise fuel/additive mixing 201. In fuel/additive mixing 201, the process 200 can further comprise providing ethyl cellulose 204, which can be the same or similar ethyl cellulose as produced via the etherification 212. During the fuel/additive mixing 201, the process 200 can further comprise providing a liquid fuel 202. The provided liquid fuel 202 can be or comprise any suitable liquid fuel or combination of liquid fuels. For example, the provided liquid fuel 202 can be or comprise gasoline, diesel, kerosene, ethanol, methanol, biodiesel, biogasoline, biofuel, crude oil, fuel oil, jet fuel, and/or the like. The provided liquid fuel 202 can be provided in a container or tank that is in operable communication with a combustion engine configured to combust the provided liquid fuel 202 to enable operation of, e.g., equipment, a vehicle, or the like. In other embodiments, the provided liquid fuel 202 can be provided in a separate container that is not in operable communication with the combustion engine. For example, the provided liquid fuel 202 can be provided in a mixing container.

In some embodiments, the provided ethyl cellulose 204 can be or comprise ethyl cellulose generated using a chemical process, such as etherification 212, from a feedstock of cellulose derived from the cellulosic material 208, which can be from one or more cellulosic and/or lignocellulosic sources, such as wood pulp or cotton linters. The etherification 212 of cellulose to form ethyl cellulose can involve a sub-process in which the cellulose derived from the provided cellulosic material 208 undergoes purification to remove impurities such as lignin and hemicellulose, the purified cellulose is then reacted with an ethyl-containing material, such as ethyl chloride, ethyl ether, or the like, e.g., in the presence of a catalyst, such as an acid like sulfuric acid or an acidic salt like zinc chloride, which causes an exothermic reaction and facilitates the substitution of hydroxyl groups in the cellulose molecules with ethyl groups to form ethyl cellulose. The resulting ethyl cellulose can then be neutralized, washed to remove residual catalysts and by-products, dried, and ground to achieve an ethyl cellulose powder having a desired particle size (e.g., particle size distribution) and consistency. This neutralized, washed, dried, and ground ethyl cellulose powder can be or comprise the provided ethyl cellulose.

As such, the provided ethyl cellulose 204 can be or comprise ethyl cellulose for which some of the hydroxyl groups on the repeating glucose units of the cellulose are replaced with ethyl ether groups. This modification (the exchange of hydroxyl groups for ethyl ether groups) may impart several unique properties to the provided ethyl cellulose 204. For example, ethyl cellulose has a melting point of about 240° C. to about 255° C. and a density of about 1.14 g/mL at 25° C. Ethyl cellulose is also insoluble in water but soluble in organic solvents such as esters, aromatic hydrocarbons, alcohols, and ketones. Ethyl cellulose also exhibits low moisture absorption, excellent dimensional stability, and resistance to acids and alkalis. These characteristics make ethyl cellulose suitable for applications requiring water repellency, film-forming properties, and chemical stability, such as for use as or comprised in the provided ethyl cellulose 204.

The process 200 further comprises forming an ethyl cellulose/fuel mix 206 from the provided liquid fuel 202 and the provided ethyl cellulose 204. In some embodiments, the formed ethyl cellulose/fuel mix 206 can be formed directly within a container or tank in operable communication with a combustion engine. In other embodiments, the formed ethyl cellulose/fuel mix 206 can be formed within an external container that is not in operable communication with a combustion engine.

In some embodiments, the provided ethyl cellulose 204, which is or comprises ethyl cellulose (e.g., in powder form), can be mixed with the provided liquid fuel 202, which is or comprises gasoline, to form the ethyl cellulose/fuel mix 206 with enhanced combustion performance and stability, and which achieves increased fuel efficiency. In other embodiments, the provided liquid fuel 202 can be combined with the provided ethyl cellulose 204 to form the ethyl cellulose/fuel mix 206.

In some embodiments, the mixing of the provided ethyl cellulose 204 and the provided liquid fuel 202 to form the ethyl cellulose/fuel mix 206 can be carried out using any suitable mixing means. For example, mixing can be performed by movement of the container into which the provided ethyl cellulose 204 and provided liquid fuel 202 are disposed or combined. In some embodiments, the mixing can be performed using a mixer, a mixing wand, a shaker, a static mixer, a paddle, etc. In some embodiments, mixing is performed or facilitated via fluid dynamic forces exerted by the materials themselves and/or the container, when disposing the provided liquid fuel 202 into the container and onto the provided ethyl cellulose 204.

In some embodiments, heat may be applied during the forming of the ethyl cellulose/fuel mix 206. Without wishing to be bound by any particular theory, the heat applied during the forming of the ethyl cellulose/fuel mix 206 can lead to better/increased dissolution, mixing, dispersion, dissipation, or homogeneity of the provided ethyl cellulose 204 in the formed fuel/additive mixture 206.

As a cellulose-derived oxygenate, ethyl cellulose can improve the combustion efficiency of fuels by increasing their oxygen content, which may help achieve more complete combustion, which may reduce emissions of pollutants such as greenhouse gases. Additionally, ethyl cellulose's solubility in organic solvents can improve the compatibility of the fuel additive across various fuel formulations. In some embodiments, ethyl cellulose may exhibit film-forming properties which may contribute to the stabilization of fuel mixtures, preventing phase separation and ensuring uniform distribution of additives. These attributes make ethyl cellulose a valuable component in the development of cleaner and more efficient fuel blends.

In some embodiments, the provided ethyl cellulose 204 can be fully or partially bio-based. The provided ethyl cellulose 204 can comprise a cellulosic, cellulose-comprising, or cellulose-based fuel additive. The provided ethyl cellulose 204 can be in powder form. The provided ethyl cellulose 204 can include or be ethyl cellulose. A purity of ethyl cellulose in the provided ethyl cellulose 204 can be between about 20% and 100%, but most formulations were found to be between about 40% pure and about 60% pure.

A method can be carried out for preparing the provided ethyl cellulose 204 that includes preparing alkali cellulose by mixing cellulose fibers with water and caustic, heating the alkali cellulose in the presence of ethyl chloride, alkyl halide, or another suitable material, and extracting the ethyl cellulose produced. The extracted ethyl cellulose can be dried to form a powder thereof.

Another method can be carried out for using the provided ethyl cellulose 204 that includes mixing a mass of ethyl cellulose in powder form with a volume of the provided liquid fuel 202 (e.g., a petrochemical, such as gasoline). The ethyl cellulose powder in the provided ethyl cellulose 204 can dissolve or partially dissolve in the liquid petrochemical of the provided liquid fuel 202. Heat may be applied to improve dissolution of the ethyl cellulose in the liquid petrochemical.

In some embodiments, a particular ratio or range of ratios of mixing of the provided ethyl cellulose 204 to the provided liquid fuel 202 can be used. To simplify the discussion of various ratios of the provided ethyl cellulose 204 to the provided liquid fuel 202, the ratio is presented as a concentration of the provided ethyl cellulose 204 in the provided liquid fuel 202. While a range of various concentrations of the provided ethyl cellulose 204 in the provided liquid fuel 202 are contemplated and contained within the present disclosure, several specific concentration values and ranges are discussed below as non-limiting examples.

A range of concentrations of the provided ethyl cellulose 204 to the provided liquid fuel 202 can be used when forming the ethyl cellulose/fuel mixture 206. For example, the concentration of the provided ethyl cellulose 204 to the provided liquid fuel 202 in the formed ethyl cellulose/fuel mixture 206 can be in the range of about 0.005 g/mL to about 0.5 g/mL, inclusive of all values and ranges therebetween. In one embodiment, the formed ethyl cellulose/fuel mixture 206 can comprise about 0.01 g/mL of the provided ethyl cellulose 204 in the provided liquid fuel 202, such as gasoline having an octane rating of between about 80 and about 95, between about 83 and about 93, between about 83 and about 91, greater than about 80, greater than about 83, greater than about 85, greater than about 87, greater than about 89, greater than about 91, or greater than about 93, inclusive of all values and ranges therebetween. In some embodiments, the formed ethyl cellulose/fuel mixture 206 can comprise about 0.02 g/mL of the provided ethyl cellulose 204 in the provided liquid fuel 202. In some embodiments, the formed ethyl cellulose/fuel mixture 206 can comprise about 0.05 g/mL of the provided ethyl cellulose 204 in the provided liquid fuel 202. In some embodiments, the formed fuel/additive mixture 206 can comprise about 0.07 g/mL of the provided ethyl cellulose 204 in the provided liquid fuel 202. In some embodiments, the formed ethyl cellulose/fuel mixture 206 can comprise about 0.10 g/mL of the provided ethyl cellulose 204 in the provided liquid fuel 202.

As a non-limiting example, an formed ethyl cellulose/fuel mixture 206 was prepared for a small engine application (e.g., an edge trimmer, lawn mower, blower, etc.) by mixing about 2 tsp of the provided ethyl cellulose 204 in powder form into about 8 fl. oz. of gasoline as the provided liquid fuel 202. Applying a unit conversion of about 1 tsp to about 4.93 mL, the approximately 2 tsp of the ethyl cellulose added to the gasoline is equivalent to about 9.86 mL. Assuming a density of ethyl cellulose of about 1.14 g/mL, this equates to about 11.24 g of ethyl cellulose added to the gasoline. Based on a unit conversion of about 29.5735 mL to 1 fl. oz., the volume of gasoline was about 236.59 mL. This resulted in a mixture of about 11.24 g of ethyl cellulose to about 236.59 mL of gasoline, for a concentration of the provided ethyl cellulose 204 in the formed ethyl cellulose/fuel mixture 206 of about 0.045 g/mL.

As another non-limiting example, an ethyl cellulose/fuel mixture 206 was prepared for a small engine application by mixing about 1 tsp of ethyl cellulose as the provided ethyl cellulose 204 in powder form into about 8 fl. oz. of gasoline as the provided liquid fuel 202. Applying a unit conversion of about 1 tsp to about 4.93 mL, approximately 4.93 mL of ethyl cellulose was added to the gasoline. Assuming a density of ethyl cellulose of about 1.14 g/mL, this equates to about 5.62 g of ethyl cellulose added to the gasoline. Based on a unit conversion of about 29.5735 mL to 1 fl. oz., the volume of gasoline was about 236.59 mL. This resulted in a mixture of about 5.62 g of ethyl cellulose to about 236.59 mL of gasoline, for a concentration of the provided ethyl cellulose 204 in the formed ethyl cellulose/fuel mixture 206 of about 0.023 g/mL.

As another non-limiting example, an ethyl cellulose/fuel mixture 206 was prepared for a small engine application by mixing about 3 tsp of ethyl cellulose as the provided ethyl cellulose 204 in powder form into about 8 fl. oz. of gasoline as the provided liquid fuel 202. Applying a unit conversion of about 1 tsp to about 4.93 mL, approximately 14.79 mL of ethyl cellulose was added to the gasoline. Assuming a density of ethyl cellulose of about 1.14 g/mL, this equates to about 16.86 g of ethyl cellulose added to the gasoline. Based on a unit conversion of about 29.5735 mL to 1 fl. oz., the volume of gasoline was about 236.59 mL. This resulted in a mixture of about 16.86 g of ethyl cellulose to about 236.59 mL of gasoline, for a concentration of the provided ethyl cellulose 204 in the formed ethyl cellulose/fuel mixture 206 of about 0.067 g/mL.

Among the above-provided non-limiting examples, the addition of provided ethyl cellulose 204 into the liquid fuel 202 at the various concentrations to form the ethyl cellulose/fuel mixture 206 resulted in combustion fuels that exhibited between about 50% and about 300% more fuel efficiency.

Figure 3:
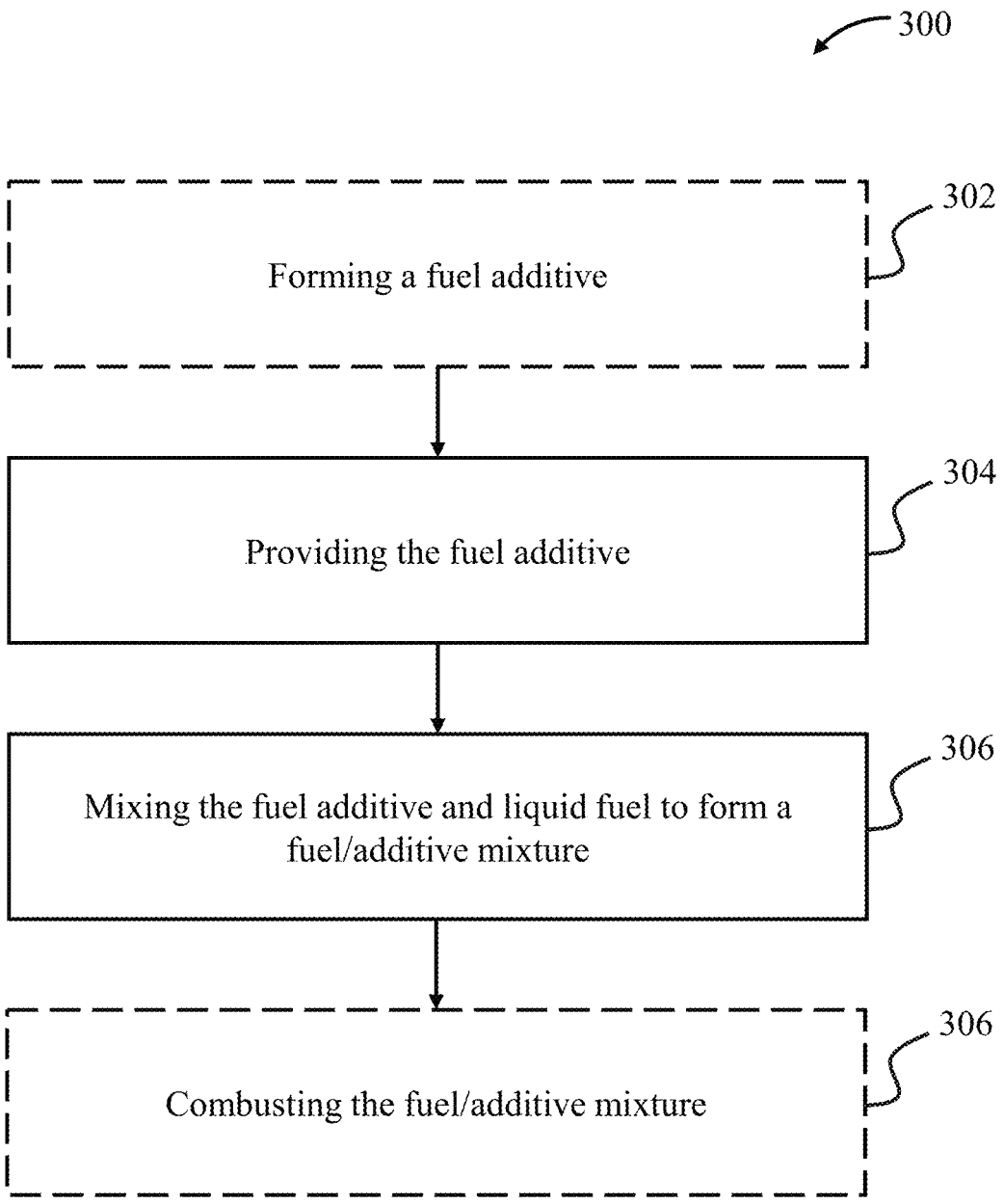
FIG. 3 is a process flow diagram illustrating a method for formulating a liquid fuel/fuel additive mixture, in accordance with one or more embodiments of the present disclosure.

Referring now to FIG. 3, a method 300 for using a fuel additive is illustrated. The method 300 includes providing a fuel additive, at 304. The method 300 further includes mixing the fuel additive with a liquid fuel to form a fuel/additive mixture, at 306. The method 300 can, optionally, further include forming the fuel additive, at 302. The method 300 can, optionally, further include combusting the fuel/additive mixture, at 306.

In some embodiments, cellulosic material can be or comprise any suitable cellulose-comprising material, cellulose-containing material, or cellulose-based material. For example, the provided cellulosic material can be sourced from one or a variety of lignocellulosic materials, such as trees, grasses, flax, hemp, jute, etc. In other embodiments, the provided cellulosic material can be sourced from one or a variety of cellulosic materials, such as fluff pulp, recycled cellulose, lab grade cellulose, cotton, and/or the like. In some embodiments, cellulose can be derived from the provided cellulosic material.

Further, as part of the forming the fuel additive 302, etherification of the cellulose derived from the cellulosic material can be performed, e.g., using ethyl ether. The etherification of the cellulose derived from the provided cellulosic material using, e.g., ethyl ether can produce ethyl cellulose.

In some embodiments, the liquid fuel can be or comprise any suitable liquid fuel or combination of liquid fuels. For example, the liquid fuel can be or comprise gasoline, diesel, kerosene, ethanol, methanol, biodiesel, biogasoline, biofuel, crude oil, fuel oil, jet fuel, and/or the like. The liquid fuel can be provided in a container or tank that is in operable communication with a combustion engine configured to combust the liquid fuel to enable operation of, e.g., equipment, a vehicle, or the like. In other embodiments, the liquid fuel can be provided in a separate container that is not in operable communication with the combustion engine. For example, the liquid fuel can be provided in a mixing container.

In some embodiments, providing the fuel additive 304 can comprise providing ethyl cellulose generated using a chemical process, such as etherification, from a feedstock of cellulose derived from the cellulosic material, which can be from one or more cellulosic and/or lignocellulosic sources, such as wood pulp or cotton linters. The etherification of cellulose to form ethyl cellulose can involve a sub-process in which the cellulose derived from the provided cellulosic material undergoes purification to remove impurities such as lignin and hemicellulose, the purified cellulose is then reacted with the provided ethyl chloride, e.g., in the presence of a catalyst, such as an acid like sulfuric acid or an acidic salt like zinc chloride, which causes an exothermic reaction and facilitates the substitution of hydroxyl groups in the cellulose molecules with ethyl groups to form ethyl cellulose. The resulting ethyl cellulose can then be neutralized, washed to remove residual catalysts and by-products, dried, and ground to achieve an ethyl cellulose powder having a desired particle size (e.g., particle size distribution) and consistency. This neutralized, washed, dried, and ground ethyl cellulose powder can be or comprise the ethyl cellulose provided 304 as the fuel additive.

As such, the ethyl cellulose can be or comprise ethyl cellulose for which some of the hydroxyl groups on the repeating glucose units of the cellulose are replaced with ethyl ether groups. This modification (the exchange of hydroxyl groups for ethyl ether groups) may impart several unique properties to the ethyl cellulose. For example, ethyl cellulose has a melting point of about 240° C. to about 255° C. and a density of about 1.14 g/mL at 25° C. Ethyl cellulose is also insoluble in water but soluble in organic solvents such as esters, aromatic hydrocarbons, alcohols, and ketones. Ethyl cellulose also exhibits low moisture absorption, excellent dimensional stability, and resistance to acids and alkalis. These characteristics make ethyl cellulose suitable for applications requiring water repellency, film-forming properties, and chemical stability, such as for use as or comprised in the fuel additive provided 304.

In some embodiments, the mixing 306 of the fuel/additive mix can performed directly within a container or tank in operable communication with a combustion engine. In other embodiments, the mixing 306 of the fuel/additive mix can be performed within an external container that is not in operable communication with a combustion engine.

In some embodiments, the mixing 306 of the fuel additive and liquid fuel forms a fuel/additive mix with enhanced combustion performance and stability, and which achieves increased fuel efficiency. In other embodiments, the mixing 306 can be carried out using any suitable mixing means. For example, the mixing 306 can be performed by movement of the container into which the provided fuel additive (e.g., ethyl cellulose) and provided liquid fuel are disposed or combined. In some embodiments, the mixing 306 can be performed using a mixer, a mixing wand, a shaker, a static mixer, a paddle, etc. In some embodiments, the mixing 306 is performed or facilitated via fluid dynamic forces exerted by the materials themselves and/or the container, when disposing the provided liquid fuel into the container and onto the provided fuel additive, e.g., ethyl cellulose.

In some embodiments, heat may be applied during the mixing 306. Without wishing to be bound by any particular theory, the heat applied during the mixing 306 can lead to better/increased dissolution, mixing, dispersion, dissipation, or homogeneity of the fuel additive (e.g., ethyl cellulose) in the liquid fuel.

As a cellulose-derived oxygenate, ethyl cellulose can improve the combustion efficiency of fuels by increasing their oxygen content, which may help achieve more complete combustion, which may reduce emissions of pollutants such as greenhouse gases. Additionally, ethyl cellulose's solubility in organic solvents can improve the compatibility of the fuel additive across various fuel formulations. In some embodiments, ethyl cellulose may exhibit film-forming properties which may contribute to the stabilization of fuel mixtures, preventing phase separation and ensuring uniform distribution of additives. These attributes make ethyl cellulose a valuable component in the development of cleaner and more efficient fuel blends.

In some embodiments, the ethyl cellulose can be fully or partially bio-based. The ethyl cellulose can comprise a cellulosic, cellulose-comprising, or cellulose-based fuel additive. The ethyl cellulose can be in powder form. A purity of ethyl cellulose in the fuel additive provided 304 can be between about 20% and 100%, but most formulations were found to be between about 40% pure and about 60% pure.

In some embodiments, forming the fuel additive 302 can include or comprise preparing alkali cellulose by mixing cellulose fibers with water and caustic, heating the alkali cellulose in the presence of ethyl chloride, alkyl halide, or another suitable material, and extracting the ethyl cellulose produced. The extracted ethyl cellulose can be dried to form a powder thereof.

In some embodiments, a particular ratio or range of ratios of the fuel additive can be used during the mixing 306 of the fuel additive and liquid fuel. While a range of various concentrations of the fuel additive (e.g., ethyl cellulose) in the liquid fuel are contemplated and contained within the present disclosure, several specific concentration values and ranges are discussed below as non-limiting examples.

A range of concentrations of the fuel additive added to the liquid fuel during the mixing 306 can be in the range of about 0.005 g/mL to about 0.5 g/mL, inclusive of all values and ranges therebetween. In one embodiment, the fuel/additive mixture can comprise about 0.01 g/mL ethyl cellulose in liquid fuel, such as gasoline having an octane rating of between about 85 and about 93. In some embodiments, the fuel/additive mixture can comprise about 0.02 g/mL of ethyl cellulose in liquid fuel. In some embodiments, the fuel/additive mixture can comprise about 0.05 g/mL of ethyl cellulose in liquid fuel. In some embodiments, the fuel/additive mixture can comprise about 0.07 g/mL of ethyl cellulose in liquid fuel. In some embodiments, the fuel/additive mixture can comprise about 0.10 g/mL of ethyl cellulose in liquid fuel.

As a non-limiting example, a fuel/additive mixture was prepared for a small engine application (e.g., an edge trimmer, lawn mower, blower, etc.) by mixing about 2 tsp of ethyl cellulose in powder form into about 8 fl. oz. of gasoline as the liquid fuel. Applying a unit conversion of about 1 tsp to about 4.93 mL, the approximately 2 tsp of the ethyl cellulose added to the gasoline is equivalent to about 9.86 mL. Assuming a density of ethyl cellulose of about 1.14 g/mL, this equates to about 11.24 g of ethyl cellulose added to the gasoline. Based on a unit conversion of about 29.5735 mL to 1 fl. oz., the volume of gasoline was about 236.59 mL. This resulted in a mixture of about 11.24 g of ethyl cellulose to about 236.59 mL of gasoline, for a concentration of the ethyl cellulose in the formed fuel/additive mixture of about 0.045 g/mL.

As another non-limiting example, a fuel/additive mixture was prepared for a small engine application by mixing about 1 tsp of ethyl cellulose in powder form into about 8 fl. oz. of gasoline as the liquid fuel. Applying a unit conversion of about 1 tsp to about 4.93 mL, approximately 4.93 mL of ethyl cellulose was added to the gasoline. Assuming a density of ethyl cellulose of about 1.14 g/mL, this equates to about 5.62 g of ethyl cellulose added to the gasoline. Based on a unit conversion of about 29.5735 mL to 1 fl. oz., the volume of gasoline was about 236.59 mL. This resulted in a mixture of about 5.62 g of ethyl cellulose to about 236.59 mL of gasoline, for a concentration of ethyl cellulose in the formed fuel/additive mixture of about 0.023 g/mL.

As another non-limiting example, a fuel/additive mixture was prepared for a small engine application by mixing about 3 tsp of ethyl cellulose in powder form into about 8 fl. oz. of gasoline as the liquid fuel. Applying a unit conversion of about 1 tsp to about 4.93 mL, approximately 14.79 mL of ethyl cellulose was added to the gasoline. Assuming a density of ethyl cellulose of about 1.14 g/mL, this equates to about 16.86 g of ethyl cellulose added to the gasoline. Based on a unit conversion of about 29.5735 mL to 1 fl. oz., the volume of gasoline was about 236.59 mL. This resulted in a mixture of about 16.86 g of ethyl cellulose to about 236.59 mL of gasoline, for a concentration of ethyl cellulose in the formed fuel/additive mixture of about 0.067 g/mL.

Among the above-provided non-limiting examples, the addition of ethyl cellulose as the fuel additive into gasoline as the liquid fuel at the various concentrations to form the fuel/additive mixture resulted in combustion fuels that, during the combusting 306, exhibited between about 50% and about 300% more fuel efficiency.

Figure 4:
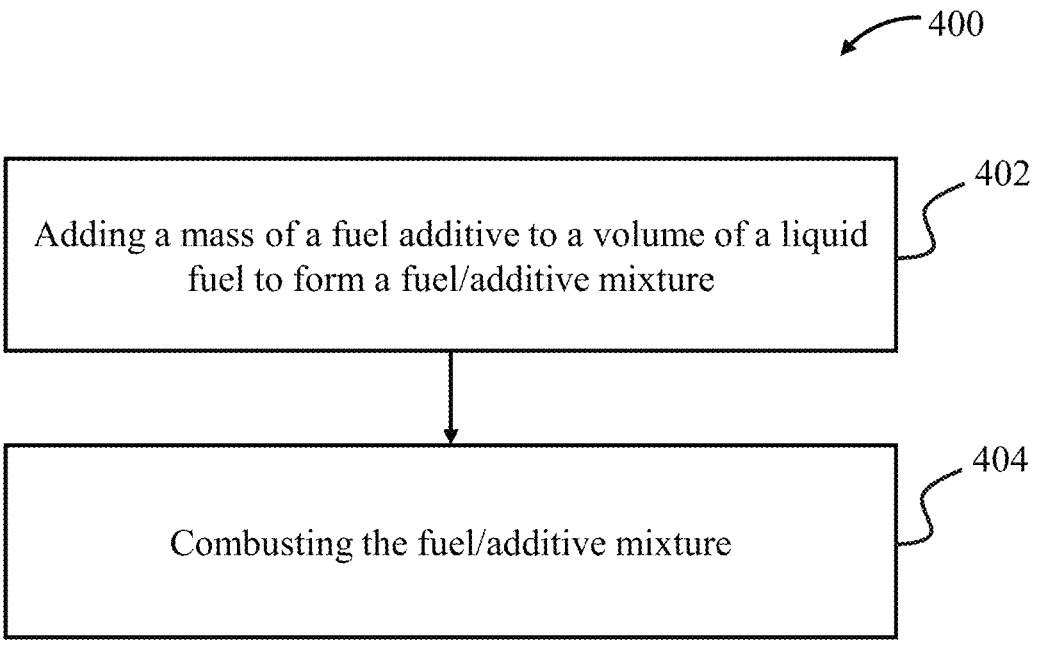
FIG. 4 is a process flow diagram illustrating a method for formulating a liquid fuel/fuel additive mixture, in accordance with one or more embodiments of the present disclosure.

Referring now to FIG. 4, a method 400 for using a fuel additive is illustrated. The method 400 includes adding a mass of a fuel additive to a volume of a liquid fuel to form a fuel/additive mixture, at 402. The method 400 further includes combusting the fuel/additive mixture, at 404.

In some embodiments, cellulosic material can be or comprise any suitable cellulose-comprising material, cellulose-containing material, or cellulose-based material. For example, the provided cellulosic material can be sourced from one or a variety of lignocellulosic materials, such as trees, grasses, flax, hemp, jute, etc. In other embodiments, the provided cellulosic material can be sourced from one or a variety of cellulosic materials, such as fluff pulp, recycled cellulose, lab grade cellulose, cotton, and/or the like. In some embodiments, cellulose can be derived from the provided cellulosic material.

Further, the fuel additive can be formed via etherification of cellulose derived from cellulosic materials or feedstocks. The etherification of the cellulose derived from the provided cellulosic material using, e.g., ethyl ether can produce ethyl cellulose.

In some embodiments, the liquid fuel can be or comprise any suitable liquid fuel or combination of liquid fuels. For example, the liquid fuel can be or comprise gasoline, diesel, kerosene, ethanol, methanol, biodiesel, biogasoline, biofuel, crude oil, fuel oil, jet fuel, and/or the like. The liquid fuel can be provided in a container or tank that is in operable communication with a combustion engine configured to combust the liquid fuel to enable operation of, e.g., equipment, a vehicle, or the like. In other embodiments, the liquid fuel can be provided in a separate container that is not in operable communication with the combustion engine. For example, the liquid fuel can be provided in a mixing container.

In some embodiments, the fuel additive can be or comprise ethyl cellulose generated using a chemical process, such as etherification, from a feedstock of cellulose derived from the cellulosic material, which can be from one or more cellulosic and/or lignocellulosic sources, such as wood pulp or cotton linters. The etherification of cellulose to form ethyl cellulose can involve a sub-process in which the cellulose derived from the provided cellulosic material undergoes purification to remove impurities such as lignin and hemicellulose, the purified cellulose is then reacted with the provided ethyl chloride, e.g., in the presence of a catalyst, such as an acid like sulfuric acid or an acidic salt like zinc chloride, which causes an exothermic reaction and facilitates the substitution of hydroxyl groups in the cellulose molecules with ethyl groups to form ethyl cellulose. The resulting ethyl cellulose can then be neutralized, washed to remove residual catalysts and by-products, dried, and ground to achieve an ethyl cellulose powder having a desired particle size (e.g., particle size distribution) and consistency. This neutralized, washed, dried, and ground ethyl cellulose powder can be or comprise the ethyl cellulose added 402 as the fuel additive to the volume of liquid fuel to form the fuel/additive mixture.

As such, the ethyl cellulose can be or comprise ethyl cellulose for which some of the hydroxyl groups on the repeating glucose units of the cellulose are replaced with ethyl ether groups. This modification (the exchange of hydroxyl groups for ethyl ether groups) may impart several unique properties to the ethyl cellulose. For example, ethyl cellulose has a melting point of about 240° C. to about 255° C. and a density of about 1.14 g/mL at 25° C. Ethyl cellulose is also insoluble in water but soluble in organic solvents such as esters, aromatic hydrocarbons, alcohols, and ketones. Ethyl cellulose also exhibits low moisture absorption, excellent dimensional stability, and resistance to acids and alkalis. These characteristics make ethyl cellulose suitable for applications requiring water repellency, film-forming properties, and chemical stability, such as for use as or comprised in the fuel additive added 402 to the liquid fuel.

In some embodiments, adding 402 can include mixing and/or heating of the fuel/additive mix, e.g., directly within a container or tank. In some embodiments, mixing can be carried out using any suitable mixing means. For example, mixing can be performed by movement of the container into which the provided fuel additive (e.g., ethyl cellulose) and provided liquid fuel are disposed or combined. In some embodiments, mixing can be performed using a mixer, a mixing wand, a shaker, a static mixer, a paddle, etc. In some embodiments, mixing is performed or facilitated via fluid dynamic forces exerted by the materials themselves and/or the container, when disposing the provided liquid fuel into the container and onto the provided fuel additive, e.g., ethyl cellulose.

In some embodiments, heat may be applied during the adding 402. Without wishing to be bound by any particular theory, the heat applied during the adding 402 can lead to better/increased dissolution, mixing, dispersion, dissipation, or homogeneity of the fuel additive (e.g., ethyl cellulose) in the liquid fuel.

In some embodiments, after adding 402 the fuel additive to the liquid fuel to form the fuel/additive mixture, the fuel/additive mixture may experience or exhibit enhanced fuel stability and enhanced combustion performance during the combusting 404.

As a cellulose-derived oxygenate, ethyl cellulose can improve the combustion efficiency of fuels during the combusting 404 by increasing their oxygen content, which may help achieve more complete combustion, which may reduce emissions of pollutants such as greenhouse gases. Additionally, ethyl cellulose's solubility in organic solvents can improve the compatibility of the fuel additive across various fuel formulations. In some embodiments, ethyl cellulose may exhibit film-forming properties which may contribute to the stabilization of fuel mixtures, preventing phase separation and ensuring uniform distribution of additives. These attributes make ethyl cellulose a valuable component in the development of cleaner and more efficient fuel blends.

In some embodiments, the ethyl cellulose can be fully or partially bio-based. The ethyl cellulose can comprise a cellulosic, cellulose-comprising, or cellulose-based fuel additive. The ethyl cellulose can be in powder form. A purity of ethyl cellulose in the fuel additive can be between about 20% and 100%, but most formulations were found to be between about 40% pure and about 60% pure.

In some embodiments, the fuel additive can be purchased or otherwise provided from an external source or formed as part of the method 400. For example, the fuel additive can be formed by preparing alkali cellulose by mixing cellulose fibers with water and caustic, heating the alkali cellulose in the presence of ethyl chloride, alkyl halide, or another suitable material, and extracting the ethyl cellulose produced. The extracted ethyl cellulose can be dried to form a powder thereof.

In some embodiments, a particular ratio or range of ratios of the fuel additive can be used during the adding 402 of the fuel additive and liquid fuel. While a range of various concentrations of the fuel additive (e.g., ethyl cellulose) in the liquid fuel are contemplated and contained within the present disclosure, several specific concentration values and ranges are discussed below as non-limiting examples.

A range of concentrations of the fuel additive added to the liquid fuel during the adding 402 can be in the range of about 0.005 g/mL to about 0.5 g/mL, inclusive of all values and ranges therebetween. In one embodiment, the fuel/additive mixture can comprise about 0.01 g/mL ethyl cellulose in liquid fuel, such as gasoline having an octane rating of between about 85 and about 93. In some embodiments, the fuel/additive mixture can comprise about 0.02 g/mL of ethyl cellulose in liquid fuel. In some embodiments, the fuel/additive mixture can comprise about 0.05 g/mL of ethyl cellulose in liquid fuel. In some embodiments, the fuel/additive mixture can comprise about 0.07 g/mL of ethyl cellulose in liquid fuel. In some embodiments, the fuel/additive mixture can comprise about 0.10 g/mL of ethyl cellulose in liquid fuel.

As a non-limiting example, a fuel/additive mixture was prepared for a small engine application (e.g., an edge trimmer, lawn mower, blower, etc.) by mixing about 2 tsp of ethyl cellulose in powder form into about 8 fl. oz. of gasoline as the liquid fuel. Applying a unit conversion of about 1 tsp to about 4.93 mL, the approximately 2 tsp of the ethyl cellulose added to the gasoline is equivalent to about 9.86 mL. Assuming a density of ethyl cellulose of about 1.14 g/mL, this equates to about 11.24 g of ethyl cellulose added to the gasoline. Based on a unit conversion of about 29.5735 mL to 1 fl. oz., the volume of gasoline was about 236.59 mL. This resulted in a mixture of about 11.24 g of ethyl cellulose to about 236.59 mL of gasoline, for a concentration of the ethyl cellulose in the formed fuel/additive mixture of about 0.045 g/mL.

As another non-limiting example, a fuel/additive mixture was prepared for a small engine application by mixing about 1 tsp of ethyl cellulose in powder form into about 8 fl. oz. of gasoline as the liquid fuel. Applying a unit conversion of about 1 tsp to about 4.93 mL, approximately 4.93 mL of ethyl cellulose was added to the gasoline. Assuming a density of ethyl cellulose of about 1.14 g/mL, this equates to about 5.62 g of ethyl cellulose added to the gasoline. Based on a unit conversion of about 29.5735 mL to 1 fl. oz., the volume of gasoline was about 236.59 mL. This resulted in a mixture of about 5.62 g of ethyl cellulose to about 236.59 mL of gasoline, for a concentration of ethyl cellulose in the formed fuel/additive mixture of about 0.023 g/mL.

As another non-limiting example, a fuel/additive mixture was prepared for a small engine application by mixing about 3 tsp of ethyl cellulose in powder form into about 8 fl. oz. of gasoline as the liquid fuel. Applying a unit conversion of about 1 tsp to about 4.93 mL, approximately 14.79 mL of ethyl cellulose was added to the gasoline. Assuming a density of ethyl cellulose of about 1.14 g/mL, this equates to about 16.86 g of ethyl cellulose added to the gasoline. Based on a unit conversion of about 29.5735 mL to 1 fl. oz., the volume of gasoline was about 236.59 mL. This resulted in a mixture of about 16.86 g of ethyl cellulose to about 236.59 mL of gasoline, for a concentration of ethyl cellulose in the formed fuel/additive mixture of about 0.067 g/mL.

Among the above-provided non-limiting examples, the addition of ethyl cellulose as the fuel additive into gasoline as the liquid fuel at the various concentrations to form the fuel/additive mixture resulted in combustion fuels that, during the combusting 404, exhibited between about 50% and about 300% more fuel efficiency.

Figure 5:
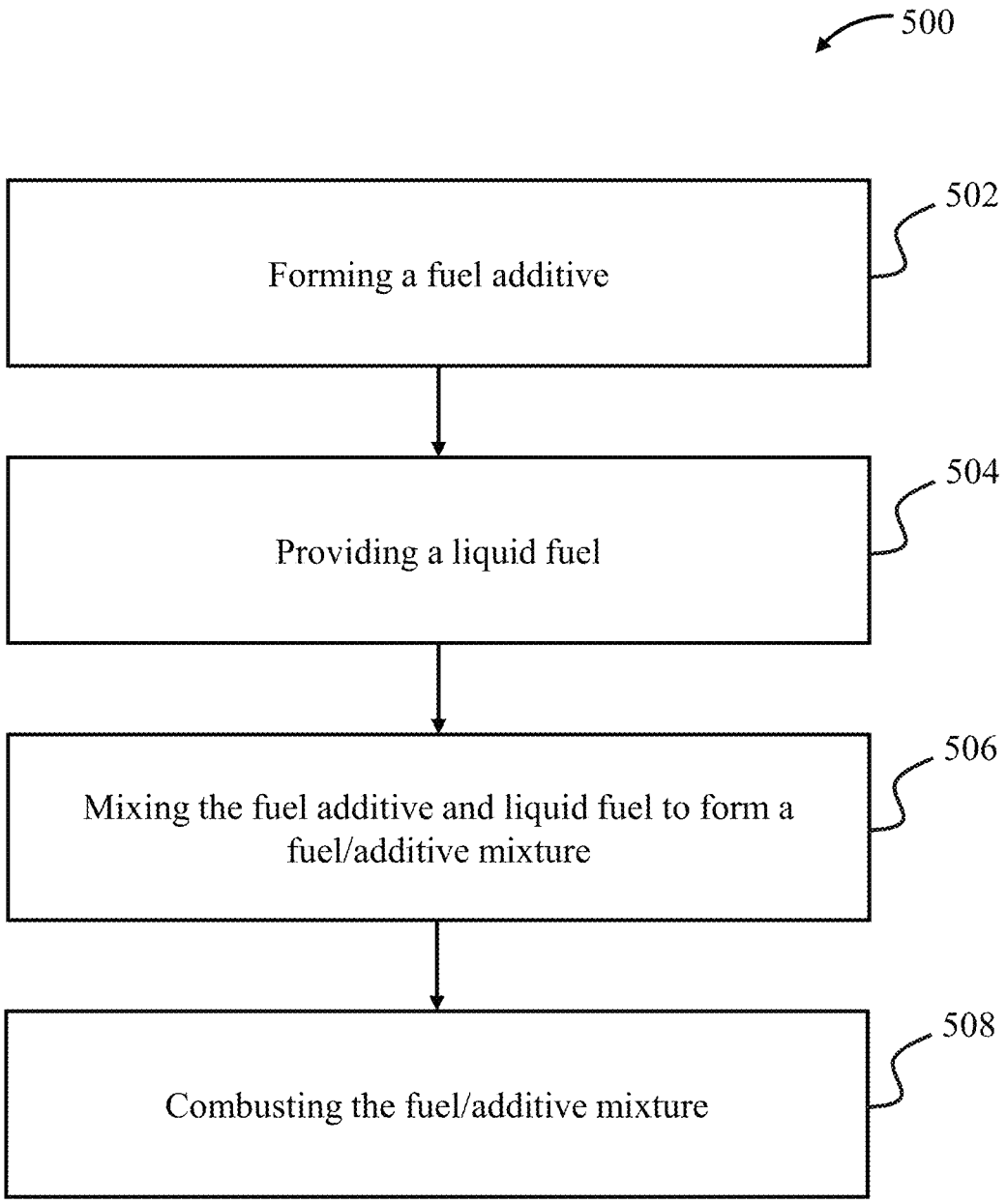
FIG. 5 is a process flow diagram illustrating a method for using a liquid fuel/fuel additive mixture, in accordance with one or more embodiments of the present disclosure.

Referring now to FIG. 5, a method 500 for using a fuel additive is illustrated. The method 500 includes forming a fuel additive, at 502. The method 500 further includes providing a liquid fuel, at 504. The method 500 further includes mixing the fuel additive and liquid fuel to forma fuel/additive mixture, at 506. The method 500 further includes combusting the fuel/additive mixture, at 508.

In some embodiments, cellulosic material can be or comprise any suitable cellulose-comprising material, cellulose-containing material, or cellulose-based material. For example, the cellulosic material can be sourced from one or a variety of lignocellulosic materials, such as trees, grasses, flax, hemp, jute, etc. In other embodiments, the cellulosic material can be sourced from one or a variety of cellulosic materials, such as fluff pulp, recycled cellulose, lab grade cellulose, cotton, and/or the like. In some embodiments, cellulose can be derived from cellulosic material.

Further, the fuel additive can be formed 502 via etherification of cellulose derived from cellulosic materials or feedstocks. The etherification of the cellulose derived from the provided cellulosic material using, e.g., ethyl ether can produce ethyl cellulose.

In some embodiments, the liquid fuel provided 504 can be or comprise any suitable liquid fuel or combination of liquid fuels. For example, the liquid fuel provided 504 can be or comprise gasoline, diesel, kerosene, ethanol, methanol, biodiesel, biogasoline, biofuel, crude oil, fuel oil, jet fuel, and/or the like. The liquid fuel can be provided 504 in a container or tank that is in operable communication with a combustion engine configured to combust the liquid fuel to enable operation of, e.g., equipment, a vehicle, or the like. In other embodiments, the liquid fuel can be provided 504 in a separate container that is not in operable communication with the combustion engine. For example, the liquid fuel can be provided 504 in a mixing container.

In some embodiments, the fuel additive formed 502 can be or comprise ethyl cellulose generated using a chemical process, such as etherification, from a feedstock of cellulose derived from the cellulosic material, which can be from one or more cellulosic and/or lignocellulosic sources, such as wood pulp or cotton linters. The etherification of cellulose to form ethyl cellulose can involve a sub-process in which the cellulose derived from the provided cellulosic material undergoes purification to remove impurities such as lignin and hemicellulose, the purified cellulose is then reacted with the provided ethyl chloride, e.g., in the presence of a catalyst, such as an acid like sulfuric acid or an acidic salt like zinc chloride, which causes an exothermic reaction and facilitates the substitution of hydroxyl groups in the cellulose molecules with ethyl groups to form ethyl cellulose. The resulting ethyl cellulose can then be neutralized, washed to remove residual catalysts and by-products, dried, and ground to achieve an ethyl cellulose powder having a desired particle size (e.g., particle size distribution) and consistency. This neutralized, washed, dried, and ground ethyl cellulose powder can be or comprise the fuel additive formed 502.

As such, the ethyl cellulose can be or comprise ethyl cellulose for which some of the hydroxyl groups on the repeating glucose units of the cellulose are replaced with ethyl ether groups. This modification (the exchange of hydroxyl groups for ethyl ether groups) may impart several unique properties to the ethyl cellulose, and therefore to the fuel additive formed 502. For example, ethyl cellulose has a melting point of about 240° C. to about 255° C. and a density of about 1.14 g/mL at 25° C. Ethyl cellulose is also insoluble in water but soluble in organic solvents such as esters, aromatic hydrocarbons, alcohols, and ketones. Ethyl cellulose also exhibits low moisture absorption, excellent dimensional stability, and resistance to acids and alkalis. These characteristics make ethyl cellulose suitable for applications requiring water repellency, film-forming properties, and chemical stability, such as for use as or comprised in the fuel additive formed 502.

In some embodiments, mixing 506 can comprise mixing and/or heating of the fuel/additive mix, e.g., directly within a container or tank. In some embodiments, mixing 506 can be carried out using any suitable mixing means. For example, mixing 506 can be performed by movement of the container into which the fuel additive (e.g., ethyl cellulose) and liquid fuel are disposed or combined. In some embodiments, mixing 506 can be performed using a mixer, a mixing wand, a shaker, a static mixer, a paddle, etc. In some embodiments, mixing 506 is performed or facilitated via fluid dynamic forces exerted by the materials themselves and/or the container, when disposing the liquid fuel into the container and onto the fuel additive, e.g., ethyl cellulose.

In some embodiments, heat may be applied during the mixing 506. Without wishing to be bound by any particular theory, the heat applied during the mixing 506 can lead to better/increased dissolution, mixing, dispersion, dissipation, or homogeneity of the fuel additive (e.g., ethyl cellulose) in the liquid fuel.

In some embodiments, after mixing 506 the fuel additive and the liquid fuel to form the fuel/additive mixture, the fuel/additive mixture may experience or exhibit enhanced fuel stability and enhanced combustion performance during the combusting 508.

As a cellulose-derived oxygenate, ethyl cellulose can improve the combustion efficiency of fuels during the combusting 508 by increasing their oxygen content, which may help achieve more complete combustion, which may reduce emissions of pollutants such as greenhouse gases. Additionally, ethyl cellulose's solubility in organic solvents can improve the compatibility of the fuel additive across various fuel formulations. In some embodiments, ethyl cellulose may exhibit film-forming properties which may contribute to the stabilization of fuel mixtures, preventing phase separation and ensuring uniform distribution of additives. These attributes make ethyl cellulose a valuable component in the development of cleaner and more efficient fuel blends.

In some embodiments, the ethyl cellulose can be fully or partially bio-based. The ethyl cellulose can comprise a cellulosic, cellulose-comprising, or cellulose-based fuel additive. The ethyl cellulose can be in powder form. A purity of ethyl cellulose in the fuel additive can be between about 20% and 100%, but most formulations were found to be between about 40% pure and about 60% pure.

In some embodiments, the fuel additive can be purchased or otherwise provided from an external source or formed as part of the method 500. For example, the fuel additive can be formed by preparing alkali cellulose by mixing cellulose fibers with water and caustic, heating the alkali cellulose in the presence of ethyl chloride, alkyl halide, or another suitable material, and extracting the ethyl cellulose produced. The extracted ethyl cellulose can be dried to form a powder thereof.

In some embodiments, a particular ratio or range of ratios of the fuel additive can be used during the mixing 506 of the fuel additive and liquid fuel. While a range of various concentrations of the fuel additive (e.g., ethyl cellulose) in the liquid fuel are contemplated and contained within the present disclosure, several specific concentration values and ranges are discussed below as non-limiting examples.

A range of concentrations of the fuel additive added to the liquid fuel during the mixing 506 can be in the range of about 0.005 g/mL to about 0.5 g/mL, inclusive of all values and ranges therebetween. In one embodiment, the fuel/additive mixture can comprise about 0.01 g/mL ethyl cellulose in liquid fuel, such as gasoline having an octane rating of between about 85 and about 93. In some embodiments, the fuel/additive mixture can comprise about 0.02 g/mL of ethyl cellulose in liquid fuel. In some embodiments, the fuel/additive mixture can comprise about 0.05 g/mL of ethyl cellulose in liquid fuel. In some embodiments, the fuel/additive mixture can comprise about 0.07 g/mL of ethyl cellulose in liquid fuel. In some embodiments, the fuel/additive mixture can comprise about 0.10 g/mL of ethyl cellulose in liquid fuel.

As a non-limiting example, a fuel/additive mixture was prepared for a small engine application (e.g., an edge trimmer, lawn mower, blower, etc.) by mixing about 2 tsp of ethyl cellulose in powder form into about 8 fl. oz. of gasoline as the liquid fuel. Applying a unit conversion of about 1 tsp to about 4.93 mL, the approximately 2 tsp of the ethyl cellulose added to the gasoline is equivalent to about 9.86 mL. Assuming a density of ethyl cellulose of about 1.14 g/mL, this equates to about 11.24 g of ethyl cellulose added to the gasoline. Based on a unit conversion of about 29.5735 mL to 1 fl. oz., the volume of gasoline was about 236.59 mL. This resulted in a mixture of about 11.24 g of ethyl cellulose to about 236.59 mL of gasoline, for a concentration of the ethyl cellulose in the formed fuel/additive mixture of about 0.045 g/mL.

As another non-limiting example, a fuel/additive mixture was prepared for a small engine application by mixing about 1 tsp of ethyl cellulose in powder form into about 8 fl. oz. of gasoline as the liquid fuel. Applying a unit conversion of about 1 tsp to about 4.93 mL, approximately 4.93 mL of ethyl cellulose was added to the gasoline. Assuming a density of ethyl cellulose of about 1.14 g/mL, this equates to about 5.62 g of ethyl cellulose added to the gasoline. Based on a unit conversion of about 29.5735 mL to 1 fl. oz., the volume of gasoline was about 236.59 mL. This resulted in a mixture of about 5.62 g of ethyl cellulose to about 236.59 mL of gasoline, for a concentration of ethyl cellulose in the formed fuel/additive mixture of about 0.023 g/mL.

As another non-limiting example, a fuel/additive mixture was prepared for a small engine application by mixing about 3 tsp of ethyl cellulose in powder form into about 8 fl. oz. of gasoline as the liquid fuel. Applying a unit conversion of about 1 tsp to about 4.93 mL, approximately 14.79 mL of ethyl cellulose was added to the gasoline. Assuming a density of ethyl cellulose of about 1.14 g/mL, this equates to about 16.86 g of ethyl cellulose added to the gasoline. Based on a unit conversion of about 29.5735 mL to 1 fl. oz., the volume of gasoline was about 236.59 mL. This resulted in a mixture of about 16.86 g of ethyl cellulose to about 236.59 mL of gasoline, for a concentration of ethyl cellulose in the formed fuel/additive mixture of about 0.067 g/mL.

Among the above-provided non-limiting examples, the addition of ethyl cellulose as the fuel additive into gasoline as the liquid fuel at the various concentrations to form the fuel/additive mixture resulted in combustion fuels that, during the combusting 508, exhibited between about 50% and about 300% more fuel efficiency.

Figure 6:
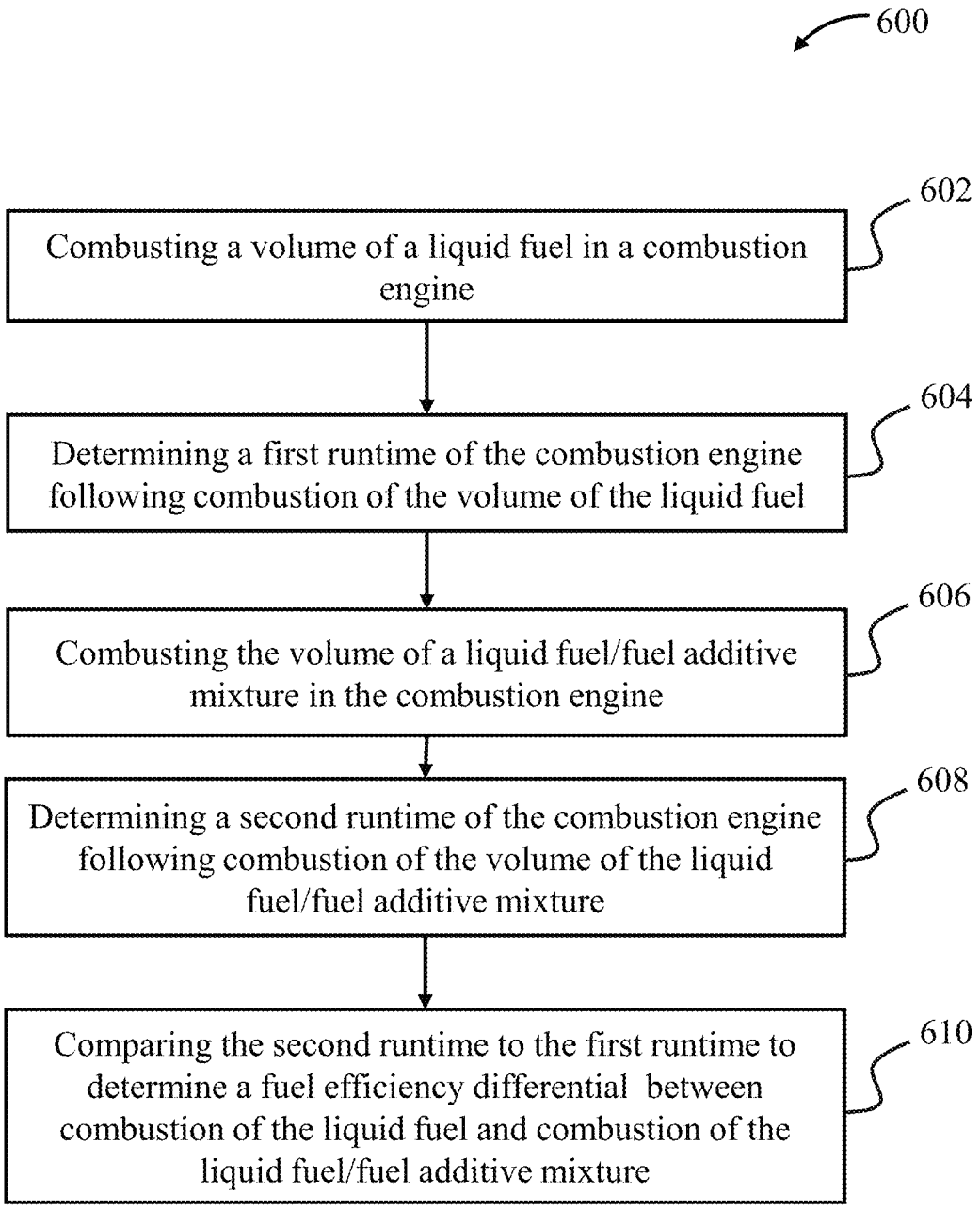
FIG. 6 is a process flow diagram illustrating a method for determining a fuel efficiency improvement achieved using a fuel additive-liquid fuel mixture, in accordance with one or more embodiments of the present disclosure.

Referring now to FIG. 6, a method 600 for determining relative fuel efficiency of different fuels when combusted in a same combustion engine is illustrated. The method 600 includes combusting a volume of a liquid fuel in a combustion engine, at 602. The method 600 further includes determining a first runtime of the combustion engine following combustion of the volume of the liquid fuel, at 604. The method 600 further includes combusting the volume of a liquid fuel/fuel additive mixture in the combustion engine, at 606. The method 600 further includes determining a second runtime of the combustion engine following combustion of the volume of the liquid fuel/fuel additive mixture, at 608. The method 600 further includes comparing the second runtime to the first runtime to determine a fuel efficiency differential between combustion of the liquid fuel and combustion of the liquid fuel/fuel additive mixture, at 610.

In a certain non-limiting example, a fuel/additive mixture was prepared for a small engine application (e.g., an edge trimmer, lawn mower, blower, etc.) by mixing about 1 tsp of ethyl cellulose in powder form into about 4 fl. oz. of gasoline as the liquid fuel. Applying a unit conversion of about 1 tsp to about 4.93 mL, the approximately 1 tsp of the ethyl cellulose added to the gasoline is equivalent to about 4.93 mL. Assuming a density of ethyl cellulose of about 1.14 g/mL, this equates to about 5.62 g of ethyl cellulose added to the gasoline. Based on a unit conversion of about 29.5735 mL to 1 fl. oz., the volume of gasoline was about 118.29 mL. The total volume of the fuel mixture produced was about 123.22 mL, in which about 5.62 g of ethyl cellulose were mixed with about 118.29 mL of gasoline, for a concentration of the ethyl cellulose in the formed fuel/additive mixture of about 0.045 g/mL.

The method 600 was performed to determine relative fuel efficiency of the fuel/additive mixture relative to a same volume combusted of just the liquid fuel without any additive. During performance of the method 600, a same edging trimmer was used at a same non-idle power level to combust approximately 123 mL of gasoline (the 'gas only' scenario) and then again to combust approximately 123 mL of a mixture of 5.62 g of ethyl cellulose mixed into 118.29 mL of gasoline (the 'additive' scenario). The test was performed until the edging trimmer ran out of fuel and turned off. Because the same volume of fuel was used, a runtime analysis of the same edging trimmer combusting the two different fuels provides for a suitable comparative analysis of fuel efficiency. This same test was performed multiple times and an average runtime in each of the 'gas only' scenario and the 'additive' scenario were averaged and analyzed. A similar test was likewise performed using other non-vehicle combustion engines, and the comparative results were found to be similar.

By performing the method 600, the fuel efficiency differential was determined between combustion of the liquid fuel itself and combustion of the liquid fuel/fuel additive mixture. In the case of the above-provided non-limiting example, it was determined that the runtime in the 'gas only' scenario was routinely between about 8 minutes and about 9 minutes when running the edging trimmer at a constant, non-idle power. Alternative, in the 'additive' scenario, the runtime was routinely over about 14 minutes. As such, 'additive' scenario was found to increase runtime (and therefore fuel efficiency) relative to the 'gas only' scenario by between about 155% and about 175%.

Many modifications and other embodiments of the inventions set forth herein will come to mind to one skilled in the art to which these inventions pertain having the benefit of teachings presented in the foregoing descriptions and the associated drawings. Although the figures only show certain components of the apparatus and systems described herein, it is understood that various other components may be used in conjunction with the supply management system. Therefore, it is to be understood that the inventions are not to be limited to the specific embodiments disclosed and that modifications and other embodiments are intended to be included within the scope of the appended claims. Moreover, the steps in the method described above may not necessarily occur in the order depicted in the accompanying diagrams, and in some cases one or more of the steps depicted may occur substantially simultaneously, or additional steps may be involved. Although specific terms are employed herein, they are used in a generic and descriptive sense only and not for purposes of limitation.

In some example embodiments, certain ones of the operations herein may be modified or further amplified as described below. Moreover, in some embodiments additional optional operations may also be included. It should be appreciated that each of the modifications, optional additions or amplifications described herein may be included with the operations herein either alone or in combination with any others among the features described herein.

The foregoing method descriptions and the process flow diagrams are provided merely as illustrative examples and are not intended to require or imply that the steps of the various embodiments must be performed in the order presented. As will be appreciated by one of skill in the art the order of steps in the foregoing embodiments may be performed in any order. Words such as "thereafter," "then," "next," etc. are not intended to limit the order of the steps; these words are simply used to guide the reader through the description of the methods. Further, any reference to claim elements in the singular, for example, using the articles "a," "an" or "the" is not to be construed as limiting the element to the singular.

Further, while operations are depicted in a particular order, this should not be understood as requiring that such operations be performed in the particular order shown or in sequential order, or that all illustrated operations be performed, to achieve desirable results. In certain circumstances, multitasking and parallel processing may be advantageous. Likewise, while several specific implementation details are contained in the above discussions, these should not be construed as limitations on the scope of the present disclosure, but rather as descriptions of features that may be specific to particular embodiments. Certain features that are described in the context of separate embodiments may also be implemented in combination in a single embodiment. Conversely, various features that are described in the context of a single embodiment may also be implemented in multiple embodiments separately or in any suitable sub-combination.

Although the present disclosure has been described in languages specific to structural features and/or methodological acts, it is to be understood that the present disclosure defined in the appended claims is not necessarily limited to the specific features or acts described above. Rather, the specific features and acts described above are disclosed as example forms of implementing the claims.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

It should be appreciated that all combinations of the foregoing concepts and additional concepts discussed in greater detail herein (provided such concepts are not mutually inconsistent) are contemplated as being part of the inventive subject matter disclosed herein. In particular, the combinations of claimed subject matter appearing at the end of this disclosure are contemplated as being part of the inventive subject matter disclosed herein. It should be appreciated that terminology explicitly employed herein that also may appear in any disclosure incorporated by reference should be accorded a meaning consistent with the particular concepts disclosed herein.

In some embodiments, one or more of the operations, steps, elements, or processes described herein may be modified or further amplified as described below. Moreover, in some embodiments, additional optional operations may also be included. It should be appreciated that each of the modifications, optional additions, and/or amplifications described herein may be included with the operations previously described herein, either alone or in combination, with any others from among the features described herein.

The provided method description, illustrations, and process flow diagrams are provided merely as illustrative examples and are not intended to require or imply that the steps of the various embodiments must each or all be performed and/or should be performed in the order presented or described. As will be appreciated by one of skill in the art, the order of steps in some or all of the embodiments described may be performed in any order. Words such as "thereafter," "then," "next," etc. are not intended to limit the order of the steps; these words are simply used to guide the reader through the description of the methods. Further, any reference to claim elements in the singular, for example, using the articles "a," "an," or "the" is not to be construed as limiting the element to the singular. Further, any reference to dispensing, disposing, depositing, dispersing, conveying, injecting, inserting, communicating, and other such terms of art are not to be construed as limiting the element to any particular means or method or apparatus or system, and is taken to mean conveying the material within the receiving vessel, solution, conduit, or the like by way of any suitable method.

The various portions of the present disclosure, such as the Background, Summary, Brief Description of the Drawings, and Abstract sections, are provided to comply with requirements of the MPEP and are not to be considered an admission of prior art or a suggestion that any portion or part of the disclosure constitutes common general knowledge in any country in the world. The present disclosure is provided as a discussion of the inventor's own work and improvements based on the inventor's own work. See, e.g., Riverwood Int'l Corp. v. R. A. Jones & Co., 324 F.3d 1346, 1354 (Fed. Cir. 2003).

What is claimed is:

1. An additive-liquid fuel mixture consisting of:

a volume of gasoline; and a mass of an ethyl cellulose, wherein the mass of the ethyl cellulose is at least partially dissolved within the volume of the gasoline.

2. The additive-liquid fuel mixture of claim 1, wherein a concentration of the ethyl cellulose in the additive-liquid fuel mixture is between about 0.01 g/mL and about 0.1 g/mL.

3. The additive-liquid fuel mixture of claim 1, wherein the additive-liquid fuel mixture is formed by mixing the mass of the ethyl cellulose in a powder form into the volume of the gasoline and allowing at least a portion of the ethyl cellulose dissolve in the gasoline.

4. The additive-liquid fuel mixture of claim 3, wherein at least one of a rate of dissolution or an extent of dissolution of the ethyl cellulose within the gasoline increases with a temperature of the additive-liquid fuel mixture during mixing.

5. The additive-liquid fuel mixture of claim 1, wherein the gasoline has an octane rating of between about 80 and about 95.

6. A method comprising:

providing a volume of an additive-liquid fuel mixture comprising:

liquid gasoline; and a mass of ethyl cellulose disposed within the liquid gasoline, wherein a concentration of the ethyl cellulose disposed in the liquid gasoline is between about 0.01 g/mL and about 0.1 g/mL; and combusting the volume of the additive-liquid fuel mixture in a combustion engine.

7. The method of claim 6, further comprising:

once all of the volume of the additive-liquid fuel mixture has been fully combusted in the combustion engine, determining a first combustion time associated with the additive-liquid fuel mixture.

8. The method of claim 7, further comprising:

providing the volume of liquid gasoline;

combusting the volume of the liquid gasoline in the combustion engine;

once all of the volume of the liquid gasoline has been fully combusted in the combustion engine, determining a second combustion time associated with the liquid gasoline; and comparing the second combustion time to the first combustion time to determine a fuel efficiency differential associated with the additive-liquid fuel mixture.

9. The method of claim 8, wherein the fuel efficiency differential of additive-liquid fuel mixture is between about 150% and about 175% based on the comparing the second combustion time associated with the liquid gasoline when combusted in the combustion engine to the first combustion time associated with the additive-liquid fuel mixture when combusted in the combustion engine.

10. The method of claim 6, further comprising:

heating the additive-liquid fuel mixture until all or substantially all of the mass of ethyl cellulose is dissolved into the volume of the liquid gasoline.

11. The method of claim 6, further comprising:

mixing the mass of ethyl cellulose into the volume of the liquid gasoline using one of: a paddle mixer, a static mixer, or using intra-tank turbulence.

12. The method of claim 6, wherein the liquid gasoline has an octane rating of between about 80 and about 95.

13. A method comprising:

mixing a mass of ethyl cellulose into a volume of gasoline;

while mixing the ethyl cellulose in the volume of gasoline, heating the mixture of the ethyl cellulose and the volume of gasoline until at least a portion of the mass of ethyl cellulose is dissolved within the volume of gasoline to form a volume of an additive-liquid fuel; and combusting the volume of the additive-liquid fuel mixture in a combustion engine.

14. The method of claim 13, wherein a concentration of the ethyl cellulose in the gasoline is between about 0.01 g/mL and about 0.1 g/mL.

15. The method of claim 13, further comprising:

once all of the volume of the additive-liquid fuel mixture has been fully combusted in the combustion engine, determining a first combustion time associated with the additive-liquid fuel mixture.

16. The method of claim 15, further comprising:

providing the volume of liquid gasoline;

combusting the volume of the liquid gasoline in the combustion engine;

once all of the volume of the liquid gasoline has been fully combusted in the combustion engine, determining a second combustion time associated with the liquid gasoline; and comparing the second combustion time to the first combustion time to determine a fuel efficiency differential associated with the additive-liquid fuel mixture.

17. The method of claim 16, wherein the fuel efficiency differential of additive-liquid fuel mixture is between about 150% and about 175% based on the comparing the second combustion time associated with the liquid gasoline when combusted in the combustion engine to the first combustion time associated with the additive-liquid fuel mixture when combusted in the combustion engine.

18. The method of claim 13, wherein the mixing the mass of ethyl cellulose into the volume of gasoline is performed using one of: a paddle mixer, a static mixer, or using intra-tank turbulence.

19. The method of claim 13, wherein the gasoline has an octane rating of between about 80 and about 95.

* * * * *